United States Patent [19]

Peters et al.

[11] 4,095,544

[45] Jun. 20, 1978

[54] PRODUCTION OF CORROSION RESISTANT SEAM-FREE CAN BODIES FROM TINPLATE

[75] Inventors: Gordon L. Peters, Weirton, W. Va.; John R. Smith, Richmond, Ohio

[73] Assignee: National Steel Corporation, Pittsburgh, Pa.

[21] Appl. No.: 735,895

[22] Filed: Oct. 26, 1976

[51] Int. Cl.[2] ..... B21D 51/26

[52] U.S. Cl. ..... 113/120 A; 113/120 H

[58] Field of Search ..... 113/120 A, 120 H; 204/37 T; 148/12 D; 29/196.4; 72/47

[56] References Cited

U.S. PATENT DOCUMENTS

| | | | |
|---|---|---|---|
| 3,129,150 | 4/1964 | Newbrander et al. | 204/37 T |
| 3,360,157 | 12/1967 | Bolt et al. | 113/120 A |
| 3,779,798 | 12/1973 | Clinton et al. | 29/196.4 |
| 3,869,261 | 3/1975 | Katsuma | 204/37 T |
| 3,934,527 | 1/1976 | Saunders | 113/120 A |
| 4,055,272 | 10/1977 | Beese | 113/120 A |

FOREIGN PATENT DOCUMENTS

| | | | |
|---|---|---|---|
| 1,131,679 | 10/1968 | United Kingdom | 204/37 T |

*Primary Examiner*—Michael J. Keenan

*Attorney, Agent, or Firm*—Shanley, O'Neil and Baker

[57] ABSTRACT

In the production of a seam-free can body from a sheet of flow brightened electrolytic tinplate by a method involving cold forming which includes a drawing step alone or a drawing step plus a redrawing step or plus a wall ironing step to produce a cold formed cup having inherently poor corrosion resistance, the improvement which comprises heat treating the cold formed cup at a temperature ranging from about 400° to about 448° F. for a period of time between about 10 minutes at the lower end of the temperature range and about 10 seconds at the upper end of the temperature range.

3 Claims, 15 Drawing Figures

FIG 6
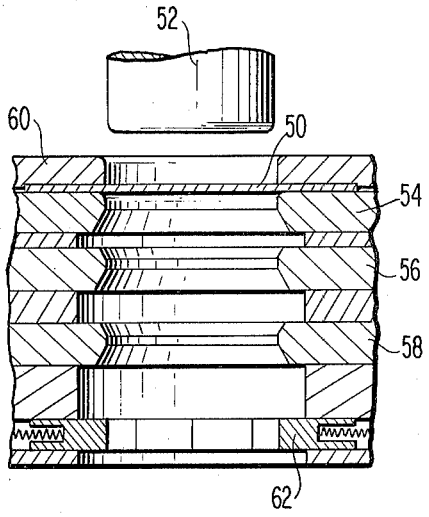
FIG 7
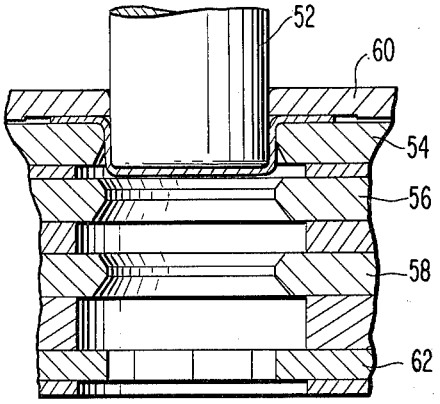
FIG 8
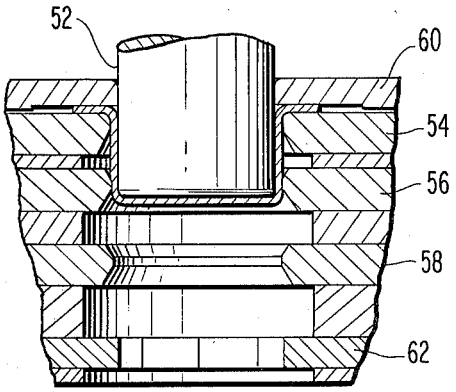
FIG 9
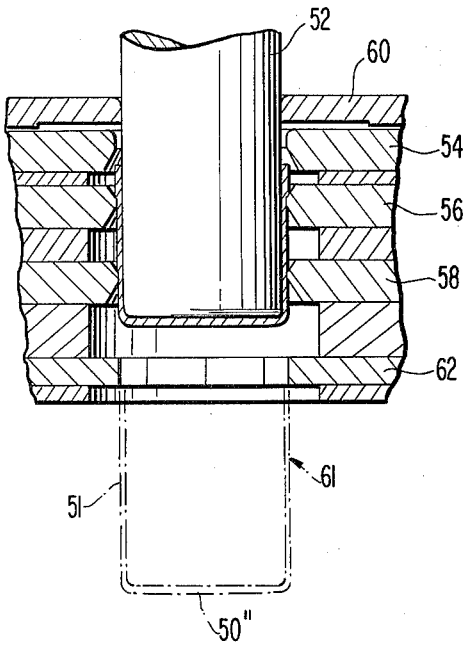
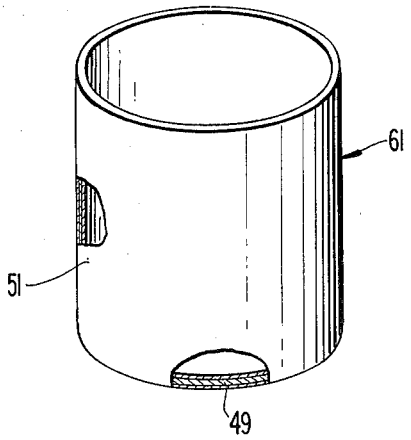
FIG 10

FIG 11
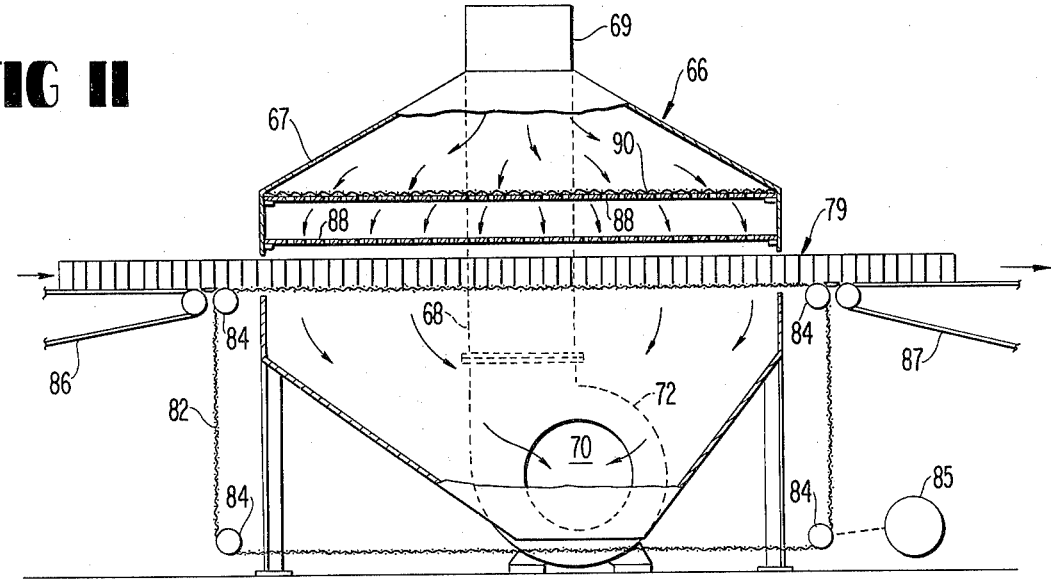
FIG 12
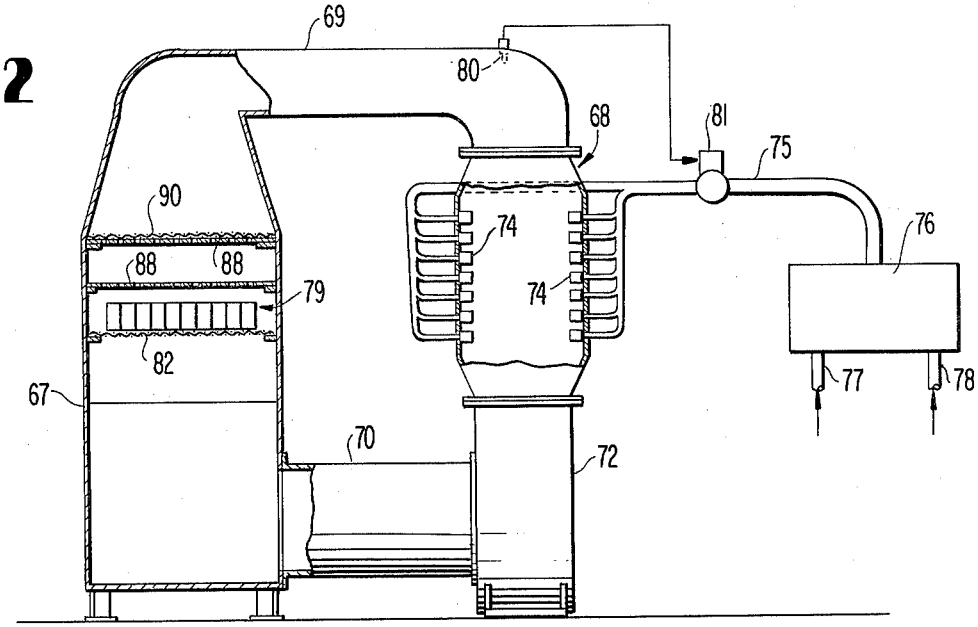
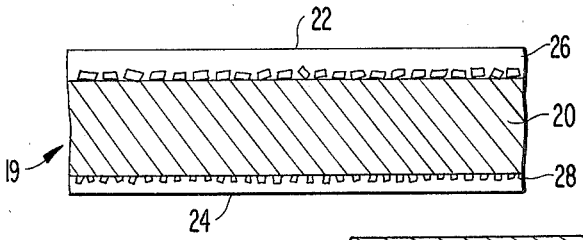
FIG 13
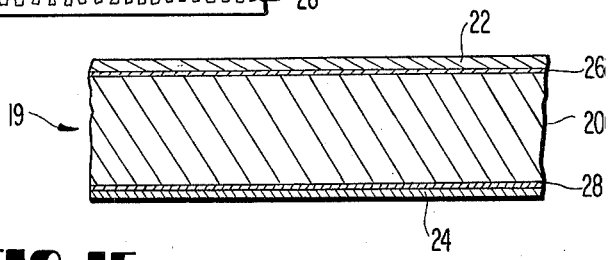
FIG 15

PRODUCTION OF CORROSION RESISTANT SEAM-FREE CAN BODIES FROM TINPLATE

BACKGROUND OF THE INVENTION

For some time, aluminum seam-free can bodies have been produced by cold forming methods including drawing steps, which cans when lined have been used for holding beverages and food products. In the latter use, the cans are referred to as sanitary containers. More recently seam-free can bodies have been formed from tinplated steel, the tinplated steel can bodies being stronger and cheaper to produce than the equivalent aluminum products. Although the tinplated steel can bodies thus produced have been satisfactory for containing beverages, unless they are lined (enameled) their corrosion resistance has not been great enough to give satisfactory service as plain sanitary containers. This is despite the fact that the tinplate starting stock for such seam-free tin can bodies does have satisfactory corrosion resistance, the cold forming of the steel can body, whether by draw and redraw or by draw and wall ironing steps, quite evidently destroyed this original satisfactory corrosion resistance of the electrotinplated starting stock.

Applicants have discovered that by treating the cold formed cups making up the bodies of the tinplated steel containers at elevated temperatures near but below the melting point of tin for controlled time periods, the satisfactory corrosion resistance of the initial tinplate starting stock can not only be restored but can even be improved.

It has been proposed to continuously heat treat tinplated continuous strip following a continuous flow brightening step to improve the shelf life of cans manufactured from the heat treated tinplate (U.S. Pat. No. 3,129,150 in which one of the applicants in the present case is a joint patentee). However, the end product of the patented process, at best, corresponds to the starting stock in the present invention and there was no reason to believe that a further similar heat treatment would improve the corrosion resistance of cold formed products.

SUMMARY OF THE INVENTION

The invention involves a method of producing a corrosion resistant seamfree can body comprising providing as a starting stock a planar sheet of steel of a thickness between about 0.025 inches and 0.005 inches having a coating of at least ¼ lb. per BB of tin on each side and a layer of iron-tin alloy between the tin coating and the steel, the ATC value of at least one side of the tin plated steel being below 0.500 microamperes per $cm^2$, subjecting the planar sheet of steel to a cold forming action, including a drawing step, to form a seamless cup having sidewalls, the steel of the sidewalls being subjected to plastic flow in the cold forming action, the said one side of the starting stock being on the inside of the cup, the ATC value of the inside of the sidewalls of the cup being above 0.500 microamperes, per $cm^2$, and subjecting the seamless cup with the tin coating exposed to an elevated temperature above about 400° F. but not greater than the melting point of tin for a period of time sufficient to lower the ATC value to a value below 0.100 microamperes, and the period of time varying between not less than about 10 minutes at the lower end of the temperature range and slightly less than the time necessary to create an objectionable form of tin-iron alloy at the upper end of the temperature range.

BRIEF DESCRIPTION OF THE FIGURES IN THE DRAWINGS

FIGS. 6, 7, 8 and 9 are fragmentary diagramatic views of successive steps in producing a seam-free can body by the draw and wall iron process;

FIG. 10 is a perspective view of a seam-free can body produced by the steps illustrated in FIGS. 6, 7, 8 and 9;

FIG. 11 is a side elevational view, partly in vertical section, showing a furnace for carrying out the heat treatment step of the present invention;

FIG. 12 is an end elevational view, partly in vertical section of the furnace of FIG. 11;

FIG. 13 is a fragmentary, enlarged cross-sectional view of a portion of the sidewall of the cup of FIG. 5;

FIG. 15 is a fragmentary, enlarged view in cross-section of a portion of the sidewall of the heat treated seam-free can body of FIG. 5.

DETAILED DESCRIPTION OF TWO VARIANTS OF THE PRESENT INVENTION

Figure 1:
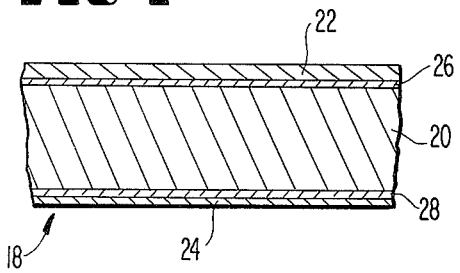
FIG. 1 is a fragmentary, enlarged cross-sectional view of a sheet of tinplate which is the starting stock for the process of the present invention.

Referring to the drawings and specifically to FIGS. 1 to 6, a cross-sectional view of a sheet of tinplate in which the steel substrate 20 has a thickness between 0.025 inches and 0.005 inches with a layer of electrolytically deposited tin 22 on the top side of the plate and electrolytically deposited layer of tin 24 on the bottom side of the substrate. Layer 22 can have a coating weight of for example ¾ pound per basebox and layer 24 can have a coating weight of for example ¼ pound per basebox. In between the tin coatings and the substrate 20 are shown the usual tin-iron alloy layers at 26 and 28, respectively. In electrolytically deposited tinplate, the tin is deposited in matte condition and the resulting coated product is subjected to a flow-brightening or reflow step which brings the temperature of the tinplate up to the fusion point of tin for a brief period of time thereby forming the tin-iron alloy layers between the tin coating and the substrate.

Figure 2:
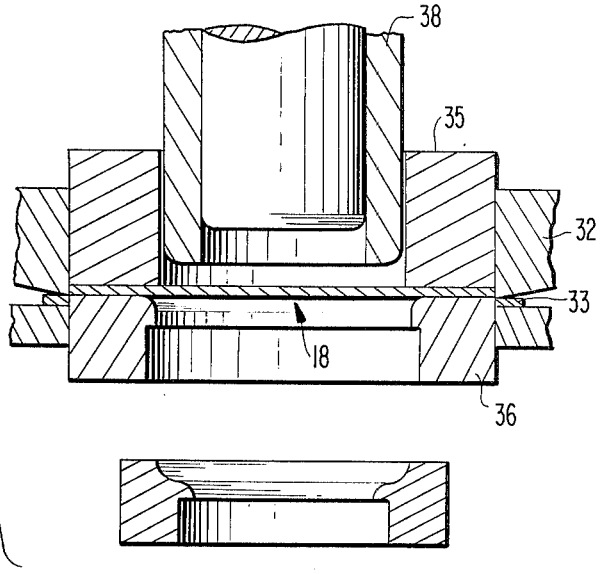
FIGS. 2, 3 and 4 are fragmentary diagramatic views of succeeding steps for producing a seam-free can body by the draw and redraw process.
Figure 3:
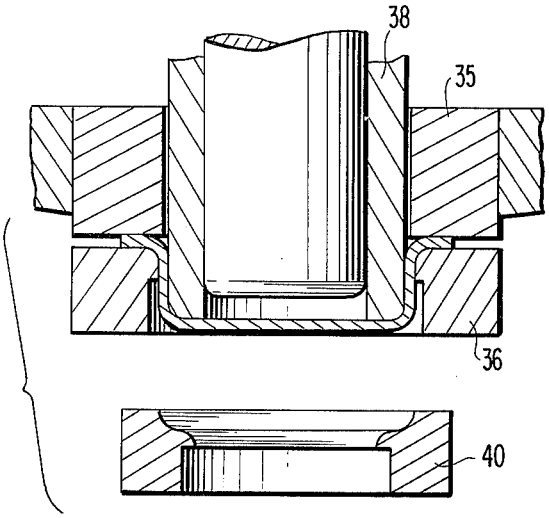
Figure 4:
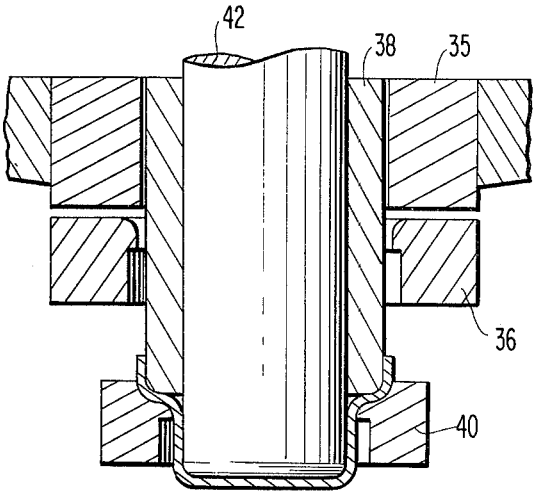
Figure 5:
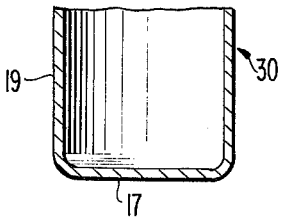
FIG. 5 is a cross-sectional view of a cup or seam-free can body produced by the steps illustrated in FIGS. 2, 3 and 4.

A sheet of tinplate such as sheet 18 forms the starting stock in the formation of a seamless can body, sometimes called a cup. FIGS. 2, 3, and 4 show successive steps in the preferred variant of the present invention wherein the sheet of tinplate is drawn and redrawn to form a cup indicated generally at 30. The draw and redraw method for forming cups is conventional and it is therefore illustrated diagramatically only, in FIGS. 2, 3 and 4.

In the FIG. 2 phase of the method, shear member 32 removes the marginal portion 33 of a sheet 18 while sheet 18 is gripped between clamp member 35 and drawing die 36. The first stage plunger 38 of the press moves downwardly as shown in FIG. 3 and performs the first drawing action, clamp member 35 and drawing die 36 gripping sheet 18 with just sufficient pressure to permit the sheet to move into the position shown in FIG. 3 as the first drawing step proceeds. When this first drawing step is completed, clamp member 35 and drawing die 36 release the partially cold formed plate 18 and primary plunger 38 carries the partially cold formed sheet down into engagement with second drawing die member 40. Then as shown in FIG. 4, the primary plunger 38 acts to clamp the partially completed product against second drawing die 40 while a secondary plunger 42 does a redrawing step in conjunction with second die 40, again the pressure maintained between primary plunger 38 and the clamping portion of second drawing die 40 being just sufficient to permit the second drawing step to complete the drawing action and produce cup 30 shown in FIG. 5.

The bottom 17 and sidewalls 19 of cup 30 have the same thickness dimension as the thickness dimension of the planar sheet 18 of the starting stock because the cold drawing action causes a type of plastic flow of the metal, in changing from the planar shape to the cylindrical shape of the sidewalls, which results from the peripheral margin of sheet 18 being turned inwardly and simultaneously smoothed into the cylindrical shape by means of drawing punch 38. Subsequent redrawing by punch 42 and die 40 turns up more of the peripheral portion of the sheet to thereby increase the length of the sidewall and substantially reduce the diameter of the cup, still without substantially reducing the thickness of the metal of the cup. This is the preferred type of cold forming in the present invention.

Turning now to FIGS. 7 to 11, a conventional drawing and wall ironing operation is illustrated in which the bottom wall of the cup produced is of the same thickness as the starting stock but the sidewalls are reduced in thickness by the ironing step or steps. This conventional type of apparatus and method are disclosed in U.S. Pat. No. 3,293,895 and to simplify the present application disclosure, the disclosure of this patent is incorporated herein by reference.

In FIG. 7, a planar sheet of tinplate 50 constitutes the starting stock which is similar in all respects to tinplate sheet 18 of FIG. 1 except that sheet 50 has already been sheared to form a circular disc. Mandrel or punch 52 is positioned in operative relation to drawing die 54 and ironing rings or dies 56 and 58, all the dies and sheet 50 being held together in the press, with sheet 50 being held between clamping element 60 and drawing die 54 with just sufficient pressure to permit the sheet or work piece to move as shown in FIGS. 8, 9 and 10 through the drawing step and succeeding wall ironing steps. Drawing die 54 acts in the same manner as drawing die 36 in FIG. 2 but wall ironing dies 56 and 58 successively act in a manner similar to extrusion dies, squeezing the metal of the sidewalls as the mandrel moves downwardly and pulls the metal through the apertures between the mandrel and the successively smaller diameter ironing rings. The drawn sidewalls 51 are thus subjected to a further but different type of plastic flow of the metal in each wall thinning action as the sidewalls pass each successive ironing ring. For practical reasons this thinning of the sidewall is not shown in the drawings. The bottom 49 of the drawn and ironed cup remains the same thickness as the starting stock.

The completed drawn and wall ironed cup, indicated generally at 61, is held by stripping device 62 which removes the cup from punch 52 as the punch is withdrawn.

FIGS. 11 and 12 disclose apparatus for carrying out applicant's heat treating step. An oven section is indicated generally by the reference numeral 66, made up of a shell or casing 67 for heating the containers and a furnace section indicated generally at 68 for producing a circulating gaseous heating medium. A conduit 69 is provided for carrying the gaseous heating medium from the furnace section to the oven section and conduit 70 for returning the circulating gaseous heating medium from the oven to the furnace section for reheating. A circulating blower 72 connects conduit 70 with base of furnace 68. Burners 74 in the furnace are supplied with a total premix of air and fuel gas by conduit 75, from mixing chamber 76 and fuel gas and air supply pipes 77 and 78. A thermostat 80 in conduit 69, acting through the medium of an electrically controlled valve 81 in fuel and air supply conduit 75, maintains the temperature of the circulating gaseous heating medium at the desired value.

An endless conveyor 82 of open mesh configuration passing through oven 67 is supported by rollers 84 and driven by motor 85 to convey the containers to be heat treated through furnace 67. Conveyor 86 carries cans to be heat treated to conveyor 82 and conveyor 87 receives and carries away containers which have been heat treated in the furnace. Representative containers are indicated at 79.

In order to assure even distribution of the circulating gaseous heating medium over the entire area occupied by cans being carried through furnace 67 on furnace conveyor 82, a pair of perforated plates 88, 88 and a diffusing screen 90 extend completely across the upper portion of the oven so that all the circulating gaseous heating medium will pass through the perforations with uniform throttling effect throughout the entire area occupied by the cans. The cans on the conveyor are in close proximity to one another and the air passes between and in heat exchange with the exterior surfaces of the cylindrical sidewalls whether the cans are upright or inverted. Due to the inherent thinness and high thermal conductivity of tinplate, the external surfaces and the internal surfaces of the sidewalls of each can come up to the temperature of the circulating gaseous heating medium very rapidly and the temperature of the oven corresponds to the temperature of the metal of the cans. By means of conventional instrumentation, the desired speed of the conveyor necessary at a chosen oven temperature to subject the containers to the desired time period of heat treatment can be readily arrived at. Again, due to the extreme thinness of tinplate, the containers cool very rapidly upon exiting from the oven; however if desired, blower means, now shown, can be used to subject the cans coming out of the oven to a cooling blast of ambient refrigerated air.

Although the form of heating means 66 illustrated in the drawings is the preferred form from a practical standpoint of convenience and ease of temperature-time control in treatment for the containers, it will be apparent that other forms, such as high frequency induction furnace means, conventional in the heating art, can be used where extremely short heat treatment time is desired. As will be brought out below, such very short treatment time may be desirable where the temperature of treatment approaches very close to the melting point of tin and in fact might, theoretically at least, even reach such point where the time of exposure to the melting temperature is insufficient to complete the actual melting of the tin or cause the formation of an objectionable alloy grain structure as described below. Of course such fine control of the temperature and time conditions may be extremely difficult to attain in practice. The present invention, of course, contemplates obtaining the optimum results within the shortest practically controllable time factor.

Considering now the desideratum of the present invention, namely, the production of a seamless tinplated steel body with satisfactory corrosion resistance for sanitary container use, it was not until recently that the corrosion resistance quality of tinplate sanitary containers could be conveniently ascertained. The corrosion performance of tinplate sanitary containers packed with acid food could always be determined by pack performance tests. These tests involve using tinplate of known production history to make containers and packing the containers with selected food products under commercial conditions. The containers are then stored under controlled conditions and tested at regular intervals until the pack fails. This is a time consuming test involving from 14 to 30 months and longer, depending upon the grade of tinplate, but for a long time it was the only method available.

In recent years, a decided advance in testing was achieved with the alloy-tin-couple test. See "The Alloy-Tin-Couple Test — A New Research Tool" by G. G. Kamm et al, "Corrosion", Volume 17, February 1961, pp. 84t–92t, for details of this test, the disclosure of this paper being incorporated herein by reference. The alloy-tin-couple test, now known as the ATC test, has been accepted by can manufacturers and tin producers alike as a satisfactory test of shelf life.

In the industry, tinplate with superior corrosion resistance is now designated as Grade K and that with average corrosion resistance as Grade J. The differences in performance for Grades K and J cannot be accounted for on the basis of variation in base steel composition or microstructure, nor can they be accounted for in the usual laboratory tests. However, the ATC test has clearly indicated that the condition of the iron-tin alloy layer is very important in understanding tinplate corrosion resistance and has given new insight into the phenomena involved. The ATC test has shown that the rate of galvanic detinning in a tinplated steel container (measured in microamperes), which is an indication of the corrosion resistance, is determined mainly by the amount and nature of the steel exposed through the combined layers of tin and tin-iron alloy. As detinning progresses and larger areas of alloy become exposed, the detinning rate increases, the rate of acceleration being dependent upon the alloy-tin-couple at the alloy surface. The development of the ATC test has led to the conclusion that in Grade K tinplate the alloy is uniform and continuous exposing very little base steel.

Along with others, applicants have theorized that in the formation of seamless tinplated steel container bodies produced by methods involving cold working of the starting stock tinplate, and including plastic flow of the metal during the cold forming, the initially uniform and continuous alloy layer is fractured and becomes discontinuous and this is what causes the reduction in corrosion resistance properties of the initially Grade K tinplate. Applicants have gone on to discover that heat treating the seamless tinplated steel containers under closely controlled conditions of temperature and time results in restoration and even improvement of the original Grade K characteristics of the starting stock tinplate.

More specifically, applicants have discovered that a heat treatment as low as 400° F., if continued for a least about 10 minutes, restored or even improved the corrosion resistance qualities of the inside of the sidewalls of tinplated steel seamless container bodies to or above the ATC values of the starting stock tinplate. Applicants' discovery included the fact that as the temperature of the heat treatment was increased, the time factor for achieving the desired results in corrosion resistance could be proportionately reduced with a practical present limit on a temperature of about 448° to about 450° F. and a time of treatment of not less than about 10 seconds.

Applicants further discovered that if the temperature of treatment was carried up to the point where the tin coating melted an objectionable grain structure developed in the tin-iron alloy, resulting in a reduction in the corrosion resistance below that desired. Applicants' experiments indicate that theoretically the temperature of the metal can be taken higher than 450° F. so long as the time of treatment is reduced and the tin coating does not melt. Thus at least theoretically, the temperature of treatment could approach very closely to and even reach the melting point of tin so long as in the last instance the time factor did not permit the formation of the objectionable grain structure.

The present invention also accomplishes the desideratum of attaining superior corrosion resistance when the starting stock is Grade J tinplate with less than superior corrosion resistance. In any event the cold forming action results in a cup or container, the inside sidewalls of which have an ATC value of more than 0.500 microamperes per $cm^2$.

The FIG. 13 cross-sectional view of a portion of the sidewall 19 of cup 30 attempts to show diagramatically how the tin-iron alloy layers 26 and 28 are believed to be fractured by the drawing and redrawing steps, the damage to the alloy layer resulting from the plastic flow of the more ductile base metal 20 and the concomitant fracturing of the more brittle alloy layer.

Figure 14:
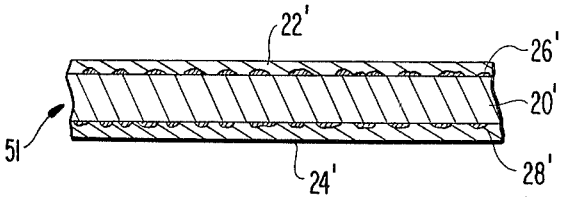
FIG. 14 is a fragmentary, enlarged view in cross section of a portion of the sidewall of the can body of FIG. 10.

FIG. 14 is similar to FIG. 13 but being a cross section of a portion of the sidewall 50 of container 61, the component parts are designated by primed numbers corresponding to those in FIG. 13. FIG. 14 attempts to show diagramatically what is believed to happen to the iron-tin alloy layer during the drawing and successive wall ironing steps. Since the base metal 20' of the sidewalls 51 of container 61 is plastically deformed by being squeezed thinner in the wall ironing steps in addition to the plastic deformation which takes place in the initial drawing step, the brittle alloy layer is discontinuous where it fails to elongate the same as the base metal.

Regardless of the type of fracturing of the iron-tin alloy layer in the drawn and redrawn cup 30 and in the drawn and ironed container 61, the corrosion resistance is greatly impaired.

FIG. 15 is an enlarged cross-sectional view of a portion of the sidewall 19 of cup 30 after applicants' heat treatment, as applicants envisage it. Regardless as to whether or not the alloy layers 26 and 28, after applicants' heat treatment, appear as shown in FIG. 15, the fact remains that the corrosion resistance is restored or improved relative to that of the original planar sheet of tinplate 18.

Containers having cylindrical sidewalls are illustrated but the containers may be of any shape which does not vary in cross section from top to bottom.

The following table stes out in terms of ATC values typical laboratory data which would result from the application of applicants' invention to draw-redraw cans formed from two examples of Grade K tinplate starting stocks having ¾ lb. per BB tincoating on the inside and ¼ lb. per BB tin coating weight on the outside of the can. The ATC values are for the inside walls of cans and are in microamps per $cm^2$; an ATC value above 0.500 indicates unsatisfactory corrosion resistance; an ATC value below 0.100 indicates satisfactory corrosion resistance and the lower the ATC value the better the corrosion resistance of the product. The temperature values given are those of the metal.

TABLE

| | | | TIME AT METAL TEMPERATURE | | | |
|---|---|---|---|---|---|---|
| CODE | STARTING STOCK | AS DRAWN | HEAT TREATED 435° F. for 2' | HEAT TREATED 440° F. for 5' | HEAT TREATED 448° F. for 30" | HEAT TREATED 450° F. for 15" |
| A-1 | .062 | .810 | .129 | .030 | .045 | .057 |
| A-2 | .069 | 1.000 | .190 | .049 | .038 | .043 |
| A-3 | .029 | .540 | .240 | .040 | .049 | .046 |
| Average | .053 | .783 | .186 | .040 | .044 | .049 |
| B-1 | .062 | .810 | .205 | .035 | .051 | .038 |
| B-2 | .060 | .910 | .220 | .028 | .047 | .053 |
| B-3 | .041 | 1.000 | .260 | .032 | .033 | .048 |
| Average | .054 | .907 | .228 | .032 | .044 | .045 |

The above described variants are to be considered in all respects as illustrative and not restrictive since the invention may be carried out in other ways without departing from its spirit or essential characteristics. Therefore, the scope of the invention is indicated by the claims rather than by the foregoing description, and all changes which come within the meaning and range of the equivalents of the claims are intended to be embraced therein.

We claim:

1. A method of producing a corrosion resistant seam-free can body comprising providing as a starting stock a planar sheet of steel of a thickness between about 0.025 inch and 0.005 inch having a coating of at least ¼ lb. per BB of tin on each side and a layer of iron-tin alloy between the tin coating and the steel, the ATC value of at least one side of the tinplated steel being below 0.500 microamperes per $cm^2$, subjecting the planar sheet of steel to a cold forming action, including a drawing step, to form a seamless cup having sidewalls, the steel of the sidewalls being subjected to plastic flow in the cold forming action, the said one side of the starting stock being on the inside of the cup, the ATC value of the inside of the sidewalls of the cup being above 0.500 microamperes per $cm^2$, and subjecting the seamless cup with the tin coating exposed to an elevated temperature above about 400° F. at the lower end of a temperature range but not greater than the melting point of tin at the upper end of the temperature range for a period of time sufficient to lower the ATC value to a value below 0.100 microamperes per $cm^2$, the period of time varying between not less than about 10 minutes at the lower end of the temperature range and slightly less than the time necessary to create an objectionable form of tin-iron alloy at the upper end of the temperature range, the temperature at the upper end of the temperature range being between about 448° and about 450° F. and the period of time and the upper end of the temperature range being not less than about 10 seconds.

2. The method of claim 1 in which the cold forming action is a draw, redraw method.

3. The method of claim 1 in which the cold forming operation is a draw and wall ironing method.

* * * * *